US012497215B2

(12) United States Patent
Wan et al.

(10) Patent No.: US 12,497,215 B2
(45) Date of Patent: Dec. 16, 2025

(54) PULP MOLDED CUP LID AND MANUFACTURING METHOD THEREFOR

(71) Applicant: Shurcon Manufacturing (Zhejiang) CO, LTD, Jiaxing (CN)

(72) Inventors: Ling Wan, Jiaxing (CN); Haifeng Huang, Jiaxing (CN); Weimin Chen, Jiaxing (CN)

(73) Assignee: Shurcon Manufacturing (Zhejiang) CO, LTD, Jiaxing (CN)

( * ) Notice: Subject to any disclaimer, the term of this patent is extended or adjusted under 35 U.S.C. 154(b) by 0 days.

(21) Appl. No.: 18/633,558

(22) Filed: Apr. 12, 2024

(65) Prior Publication Data

US 2024/0294307 A1 Sep. 5, 2024

Related U.S. Application Data

(63) Continuation of application No. PCT/CN2022/076385, filed on Feb. 15, 2022.

(30) Foreign Application Priority Data

Oct. 14, 2021 (CN) ..... 202122482822.6

(51) Int. Cl.
*B65D 43/02* (2006.01)

(52) U.S. Cl.
CPC ..... *B65D 43/0212* (2013.01); *B65D 2543/00046* (2013.01); *B65D 2543/00092* (2013.01); *B65D 2543/00268* (2013.01); *B65D 2543/00537* (2013.01); *B65D 2543/00629* (2013.01); *B65D 2543/00685* (2013.01); *B65D 2543/00759* (2013.01); *B65D 2543/00796* (2013.01)

(58) Field of Classification Search
CPC ..... B65D 43/0212; B65D 2543/00046; B65D 2543/00092; B65D 2543/00268; B65D 2543/00537; B65D 2543/00629; B65D 2543/00685; B65D 2543/00759; B65D 2543/00796
See application file for complete search history.

(56) References Cited

U.S. PATENT DOCUMENTS

2011/0139800 A1* 6/2011 Urban ..... B29D 99/0096 229/404
2016/0319490 A1* 11/2016 Wang ..... B65D 43/0212
2017/0021979 A1* 1/2017 Lai ..... D21J 3/00
2018/0086511 A1* 3/2018 Lin ..... D21J 3/10

* cited by examiner

*Primary Examiner* — James N Smalley
(74) *Attorney, Agent, or Firm* — Zhigang Ma

(57) ABSTRACT

A pulp molded cup lid includes a lid top portion, a transverse extension portion and a longitudinal extension portion. The transverse extension portion is connected to a lower side of an outer edge of the lid top portion and extends radially outward. The longitudinal extension portion is connected to an outer edge of the transverse extension portion and extends axially downward. The longitudinal extension portion is cylindrical. The pulp molded cup lid further includes an inner convex buckle disposed on an inner wall of the longitudinal extension portion. The inner convex buckle is integrally formed with the longitudinal extension portion. The inner convex buckle protrudes inward relative to the inner wall of the longitudinal extension portion. An outer wall of the longitudinal extension portion defines a rolling groove. The rolling groove is configured to further reduce an inner diameter of the inner convex buckle.

11 Claims, 4 Drawing Sheets

PULP MOLDED CUP LID AND MANUFACTURING METHOD THEREFOR

CROSS-REFERENCE TO RELATED APPLICATIONS

This application is a continuation of International Application No. PCT/CN2022/076385 filed on Feb. 15, 2022, which claims the priority of Chinese patent application No. CN 202122482822.6 filed on Oct. 14, 2021, both of which are herein incorporated by reference in their entireties.

TECHNICAL FIELD

The disclosure relates to the field of manufacturing technologies of pulp cup lids, particularly to a pulp molded cup lid and a manufacturing method therefor.

BACKGROUND

Typically, an existing inner wall of a pulp molded cup lid is provided with an inner convex buckle, and the inner convex buckle is buckled on a corresponding cup to achieving sealing between the pulp molded cup lid and the cup. The existing pulp molded cup lid has various structures. For example, a pulp molded cup lid produced by Xingzhong Environmental Protection Company in Taiwan Province, China has an inner convex buckle directly disposed on a side wall of an inverted U-shaped groove. In addition, a pulp molded cup lid produced by some companies has a uniform wall thickness, an outer wall of the pulp molded cup lid is processed by rolling or spinning to form a processing groove, and an inner convex buckle corresponding to the processing groove is disposed on an inner wall of the pulp molded cup lid.

The above two types of pulp molded cup lids basically cover all ways for forming the inner convex buckles. Although the above-mentioned two types of pulp molded cup lids can be locked with corresponding cups, there are still some defects in the above-mentioned two types of pulp molded cup lids. For example, an inner diameter of the inner convex buckle directly disposed on the side wall of the pulp molded cup lid (i.e., the pulp molded cup lid produced by Xingzhong Environmental Protection Company) increases due to radially outward expansion of the inner convex buckle due to demoulding, and the sealing between the pulp molded cup lid and the cup is greatly reduced. At the same time, this manufacturing method is not conducive to the demoulding of the pulp molded cup lid, which leads lower efficiency and higher product scrap rate.

In addition, although the inner convex buckle can be formed by rolling for the pulp molded cup lid with a uniform wall thickness (i.e., the pulp molded cup lid produced by the some companies), when the pulp molded cup lid is closed on the corresponding cup for the second time, the inner convex buckle will have a larger radial outward expansion deformation (the pulp molded cup lid with a uniform wall thickness has a poor structural strength), thereby resulting in poor sealing between the pulp molded cup lid and the cup, as such, there are phenomena such as sealing leakage.

SUMMARY

An objective of the disclosure is to provide a pulp molded cup lid, which can solve the above technical problems.

In order to achieve the above objective, the disclosure proposes the following technical solutions.

An embodiment of the disclosure provides a pulp molded cup lid. The pulp molded cup lid includes: a lid top portion, a transverse extension portion, and a longitudinal extension portion. The transverse extension portion is connected to a lower side of an outer edge of the lid top portion and extends radially outward. The longitudinal extension portion is connected to an outer edge of the transverse extension portion and extends axially downward. The longitudinal extension portion is cylindrical. The pulp molded cup lid further includes an inner convex buckle. The inner convex buckle is disposed on an inner wall of the longitudinal extension portion. The inner convex buckle and the longitudinal extension portion are integrated into a single-piece structure. The inner convex buckle protrudes inward relative to the inner wall of the longitudinal extension portion. An outer wall of the longitudinal extension portion defines a rolling groove, and the rolling groove is configured to further reduce an inner diameter of the inner convex buckle.

In an embodiment, in the pulp molded cup lid, a spacing between a groove bottom of the rolling groove and an inner convex top of the inner convex buckle is greater than a thickness of a single side wall of the longitudinal extension portion.

In an embodiment, in the pulp molded cup lid, a groove depth of the rolling groove is smaller than a protrusion length between an inner convex top of the inner convex buckle and the inner wall of the longitudinal extension portion.

In an embodiment, in the pulp molded cup lid, the rolling groove is a V-shaped annular groove.

In an embodiment, in the pulp molded cup lid, the inner convex buckle is an annular inner convex buckle.

In an embodiment, in the pulp molded cup lid, a number of the inner convex buckle is multiple, the multiple inner convex buckles are respectively multiple arc-shaped inner convex buckles, and the multiple arc-shaped inner convex buckles are evenly distributed around an inner circumference of the longitudinal extension portion.

In an embodiment, in the pulp molded cup lid, the inner convex buckle is disposed on a middle of the inner wall of the longitudinal extension portion.

In an embodiment, in the pulp molded cup lid, a longitudinal section of a side of the longitudinal extension portion includes: an upper thicker part, and a lower thinner part connected to a lower side of the upper thick part; and the inner convex buckle is disposed on an inner wall of the upper thicker part.

In an embodiment, in the pulp molded cup lid, a longitudinal section of a side of the longitudinal extension portion includes: an upper thicker part, and a lower thinner part connected to a lower side of the upper thick part; and the inner convex buckle is disposed on an inner wall of a joint between the upper thicker part and the lower thinner part.

In an embodiment, in the pulp molded cup lid, the inner wall of the longitudinal extension portion includes an upper vertical inner wall and a lower inclined outward inner wall sequentially disposed in that order from top to bottom; the inner convex buckle has a top arc-shaped convex surface; and the top arc-shaped convex surface is connected to the upper vertical inner wall and the lower inclined outward inner wall respectively through connecting concave surfaces.

In an embodiment, in the pulp molded cup lid, the transverse extension portion includes a straight horizontal transverse part and an upward arched part, and a lower surface of the straight horizontal transverse part and a lower surface of the upward arched part are connected with each other by an arc-shaped transition convex surface.

Compared with the related art, the disclosure has at least the following advantages.

After the inner convex buckle is integrally formed with the longitudinal extension portion, the rolling groove is used for further inward extrusion processing on the inner convex buckle, as such, the inner diameter of the inner convex buckle will be further reduced, and the reduction of the inner diameter of the inner convex buckle can improve a locking force of the cup lid on the cup, and can ensure the sealing performance after the cup lid is removed from the cup and closed on the cup for many times.

Owing to the designing of the rolling groove in the disclosure, the inner diameter of the inner convex buckle may be appropriately reduced during integral forming, and the reduction of the inner diameter can reduce the difficulty of demoulding, reduce the difficulty of mold processing, and further reduce the manufacturing cost thereof.

The inner convex buckle increases the wall thickness of the longitudinal extension portion, which can prolong the service life and improve the structural strength of the pulp molded cup lid.

REFERENCE NUMERALS

1—pulp molded cup lid; 2—cup; 10—lid top portion; 100—drinking port; 101—venting hole; 20—transverse extension portion; 200—straight horizontal transverse part; 201—upward arched part; 202—arc-shaped transition convex surface; 30—longitudinal extension portion; 300—upper thicker part; 301—lower thinner part 301; 302—upper vertical inner wall; 303—lower inclined outward inner wall; 40—inner convex buckle; 400—top arc-shaped convex surface; 401—connecting concave surface; 50—rolling groove; 60—top flange; L1—spacing; L2—protrusion length; H—thickness; D—groove depth.

DETAILED DESCRIPTION OF EMBODIMENTS

Technical solutions of the disclosure will be further described hereinafter combined with specific embodiments and accompanying drawings of the disclosure, but the disclosure is not limited to these specific embodiments.

First Embodiment

Figure 1:
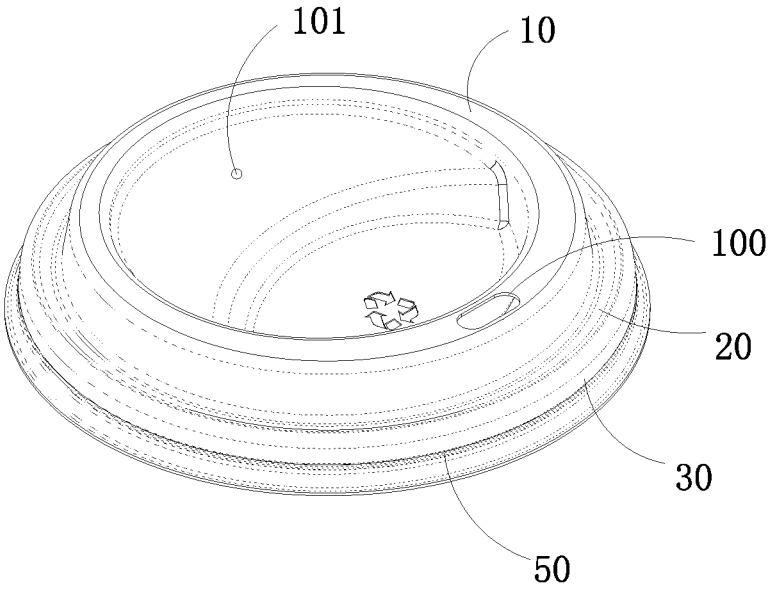
FIG. 1 illustrates a schematic perspective view of a pulp molded cup lid according to a first embodiment of the disclosure.
Figure 2:
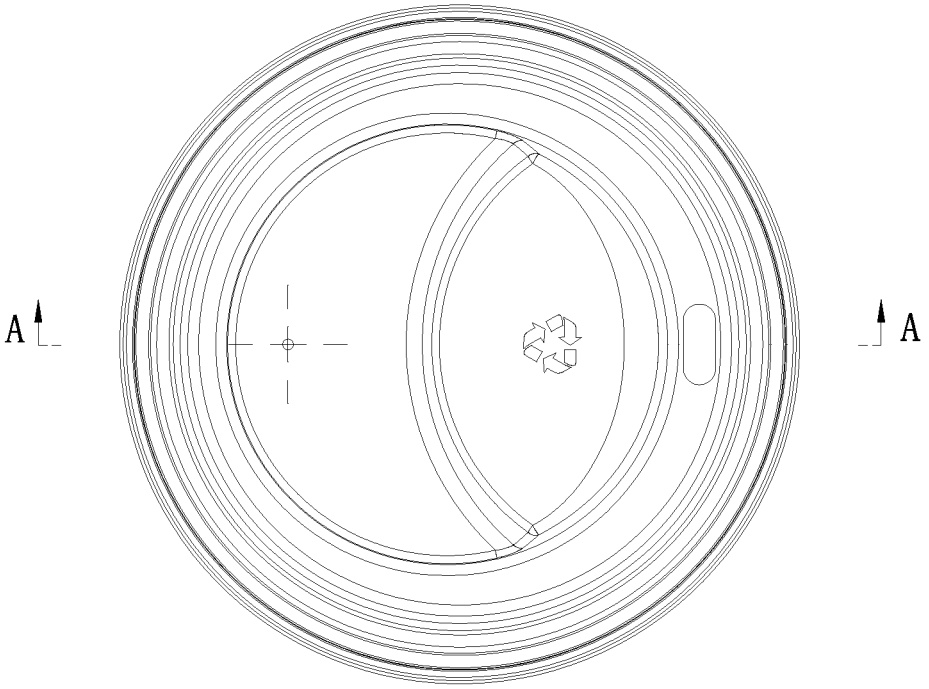
FIG. 2 illustrates a schematic top view of the pulp molded cup lid according to the first embodiment of the disclosure.

As illustrated in FIGS. 1 and 2, a pulp molded cup lid provided by the first embodiment includes a lid top portion 10. The lid top portion 10 has a sunken part in a center of the lid top portion 10, and a drinking port 100 and a venting hole 101 disposed on the lid top portion 10.

Figure 3:
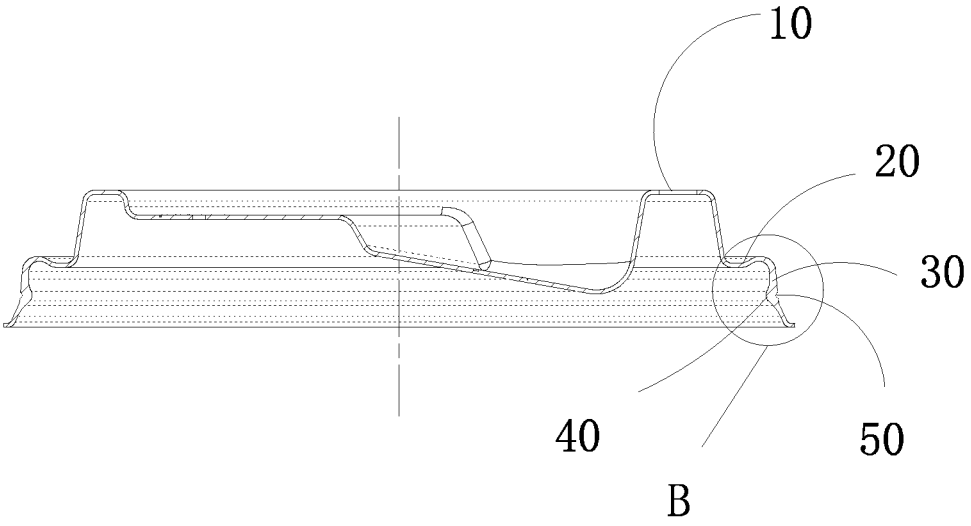
FIG. 3 illustrates a schematic sectional view of the pulp molded cup lid taken along a line A-A in FIG. 2.
Figure 4:
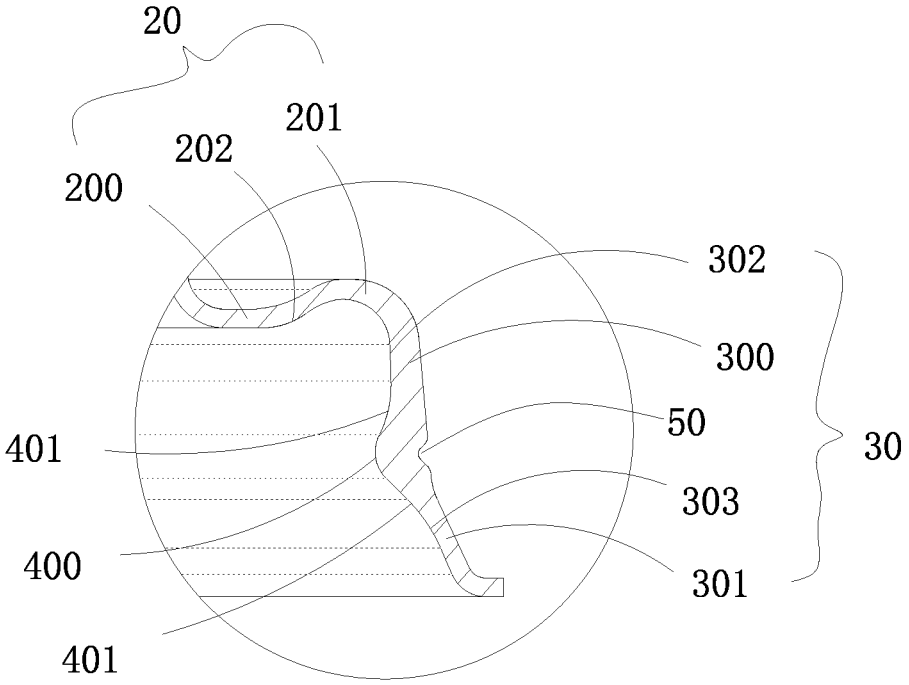
FIG. 4 illustrates an enlarged schematic structural diagram of the pulp molded cup lid at a position B in FIG. 3.
Figure 5:
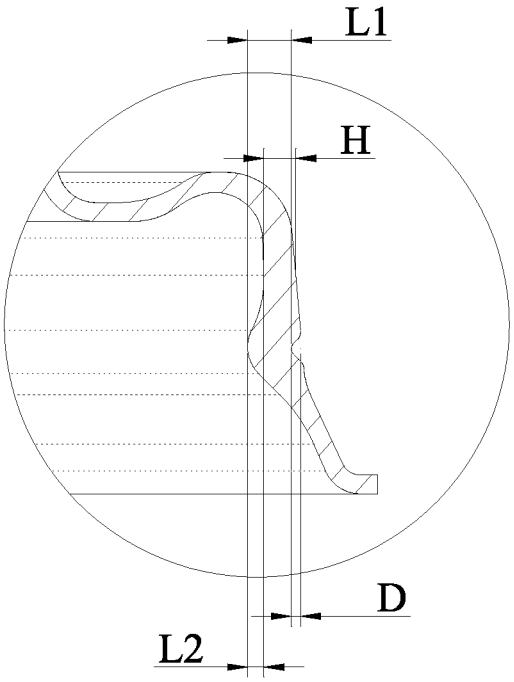
FIG. 5 illustrates a schematic view of a structure of FIG. 4 without reference numbers.

The pulp molded cup lid further includes a transverse extension portion 20, which is connected to a lower side of an outer edge of the lid top portion 10 and extends radially outward (i.e., extending in a radial direction of the lid top portion 10). Specifically, as illustrated in FIG. 3 through FIG. 5, the transverse extension portion 20 includes a straight horizontal transverse part 200 and an upward arched part 201 (i.e., the straight horizontal transverse part 200 arches downward relative to the upward arched part 201, and the upward arched part 201 arches upward relative to the straight horizontal transverse part 200), and a lower surface of the straight horizontal transverse part 200 and a lower surface of the upward arched part 201 are connected by an arc-shaped transition convex surface 202.

The straight horizontal transverse part 200 is connected to the lower side of the outer edge of the lid top portion 10, and the upward arched part 201 is connected to an outer edge of the straight horizontal transverse part 200 facing away from the lid top portion 10.

The arc-shaped transition convex surface 202 can facilitate the pulp molded cup lid to abut against of a top flange of a cup, thereby providing the pulp molded cup lid with closure stability, and facilitating the removal of the pulp molded cup lid.

The pulp molded cup lid further includes a longitudinal extension portion 30, which is connected to an outer edge of the transverse extension portion 20 and extends axially downward (i.e., extending in an axial direction of the lid top portion 10). The longitudinal extension portion 30 is cylindrical. The longitudinal extension portion 30 has only one inner wall, as such, after the pulp molded cup lid is matched with a corresponding cup, the pulp molded cup lid and the cup can form an outer unilateral seal.

The pulp molded cup lid further includes an inner convex buckle 40 disposed on an inner wall of the longitudinal extension portion 30, the inner convex buckle 40 protrudes inward relative to the inner wall of the longitudinal extension portion 30, and the longitudinal extension portion 30 is integrally formed with the inner convex buckle 40 (i.e., the longitudinal extension portion 30 and the inner convex buckle 40 are integrated into a single-piece structure). This integrated forming manner can improve the manufacturing efficiency and the structural strength of the pulp molded cup lid. The inner convex buckle 40 can be buckled on the top flange of the cup to form an outer seal.

As illustrated in FIG. 3 through FIG. 5, an outer wall of the longitudinal extension portion 30 defines a rolling groove 50, which can further reduce an inner diameter of the inner convex buckle 40. The rolling groove 50 is a machined rolling groove or a machined spinning groove. After the inner convex buckle 40 is integrally formed with the longitudinal extension portion 30, the rolling groove 50 is used for further inward extrusion processing on the inner convex buckle 40, as such, the inner diameter of the inner convex buckle 40 will be further reduced, and the reduction of the inner diameter of the inner convex buckle 40 can improve a locking force of the cup lid on the cup, and can ensure the sealing performance after the cup lid is removed from the cup and closed on the cup for many times. Further, owing to the designing of the rolling groove 50 in this embodiment, the inner diameter of the inner convex buckle 40 may be appropriately reduced during integral forming, and the reduction of the inner diameter can reduce the difficulty of demoulding, reduce the difficulty of mold processing and further reduce the manufacturing cost thereof. After the integral forming is completed, a rolling process is carried out, so that the inner diameter of the inner convex buckle 40 reaches a set inner diameter or is smaller than the set inner diameter.

Figure 8:
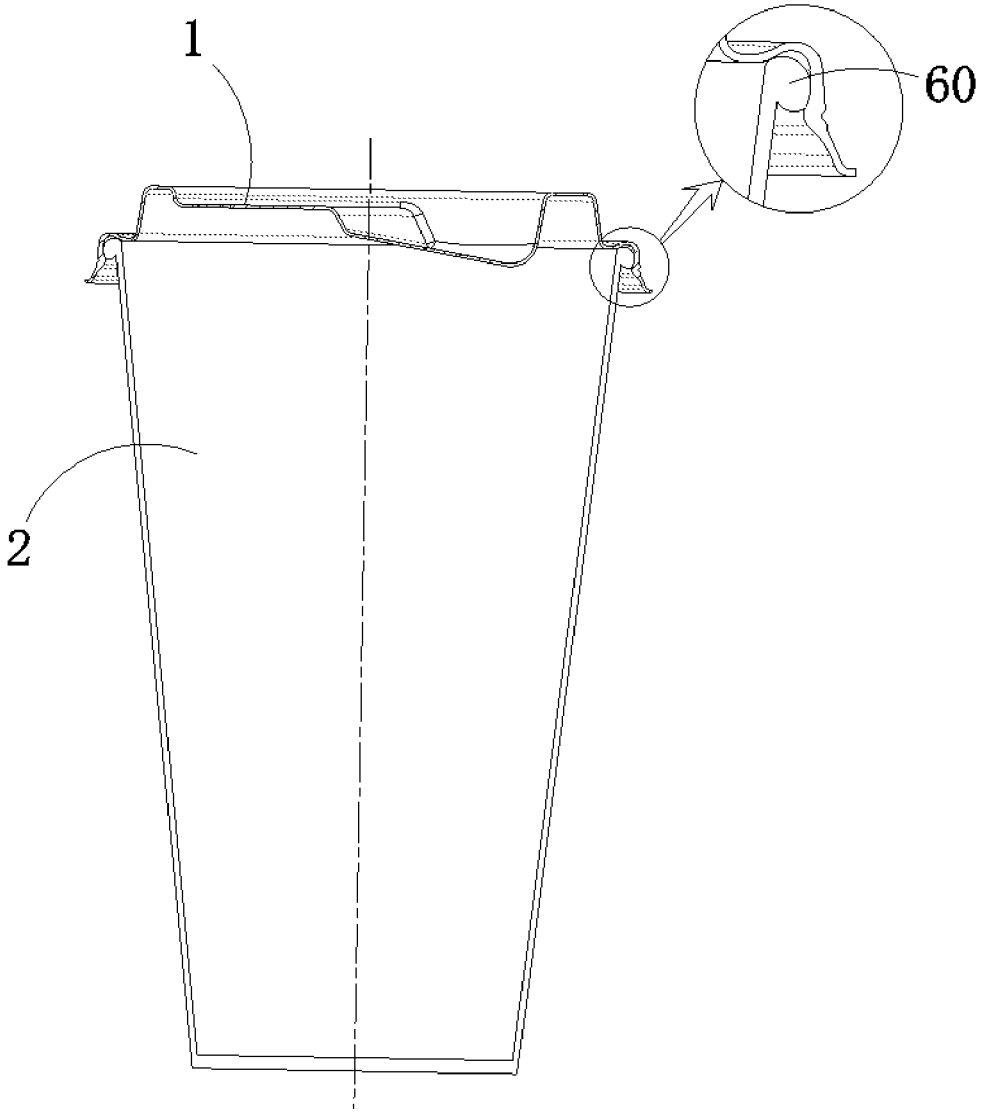
FIG. 8 illustrates a schematic structural diagram of a pulp molded cup kit according to a fourth embodiment of the disclosure.

In an embodiment, the inner convex buckle 40 is disposed on the middle of the inner wall of the longitudinal extension portion 30. When the pulp molded cup lid is matched with a cup 2, as illustrated in FIG. 8, a top flange 60 of the cup 2 is located above the inner convex buckle 40 and buckled to a lower side of the pulp molded cup lid. Of course, in some embodiments, the inner convex buckle 40 may also be disposed slightly above the middle of the inner wall of the longitudinal extension portion 30.

In an embodiment, a spacing L1 between a groove bottom of the rolling groove 50 and an inner convex top of the inner convex buckle 40 is greater than a thickness (H) of a single side wall of the longitudinal extension portion 30, as illustrated in FIG. 5. This structure mainly strengthens a wall thickness of the pulp molded cup lid where the inner convex buckle 40 is arranged, to prevent radial deformation of the inner convex buckle 40 under the condition of self-deformation or radial expansion force during demoulding.

In an embodiment, as shown in FIG. 3 through FIG. 5, a groove depth of the rolling groove 50 in a radial direction of the pulp molded cup lid is smaller than a protrusion length L2 between the inner convex top of the inner convex buckle 40 and the inner wall of the longitudinal extension portion 30. The advantage of this structure is to improve a wall thickness strength of the pulp molded cup lid where the inner convex buckle 40 is arranged.

In an embodiment, the rolling groove 50 is a V-shaped annular groove, that is, a circle of annular groove, which can facilitate processing and manufacturing and provide a circle of sealing. Further, the groove bottom of the rolling groove 50 is circular, and chamfers are provided on both sides of a notch of the rolling groove 50 to prevent the notch from being cut off, and at the same time, the aesthetics can be improved.

In an embodiment, the inner convex buckle 40 is an annular inner convex buckle. The design of the annular inner convex buckle can improve the sealing performance of a circle for the cup and form radial structural reinforcement for the inner convex buckle 40.

In an embodiment, as illustrated in FIG. 3 through FIG. 5, a longitudinal section of a side of the longitudinal extension portion 30 includes an upper thicker part 300 and a lower thinner part 301 connected to a lower side of the upper thicker part 300. The inner convex buckle 40 is disposed on an inner wall of the upper thicker part 300; or the inner convex buckle 40 is disposed on an inner wall of a joint between the upper thicker part 300 and the lower thinner part 301.

In an embodiment, a thickness of the upper thicker part 300 and a thickness of the lower thinner part 301 are equal.

In an alternative embodiment, the thickness of the upper thicker part 300 is greater than that of the lower thinner part 301, which can improve the matching strength between the pulp molded cup lid and the cup when locking, and at the same time, it is convenient to improve the structural strength of the upper thicker part 300 provided with the inner convex buckle 40.

In an embodiment, the inner wall of the longitudinal extension portion 30 further includes an upper vertical inner wall 302 and a lower inclined outward inner wall 303 sequentially disposed in that order from top to bottom. Specifically, the upper vertical inner wall 302 is disposed on the inner wall of the upper thicker part 300, and an outer wall of the upper thicker part 300 is an outward inclined surface. The lower inclined outward inner wall 303 is disposed on an inner wall of the lower thinner part 301, the lower inclined outward inner wall 303 is an inclined slope or a larger inclined circular concave surface, and an outer wall of the lower thinner part 301 is a downward inclined outer slope. That is, the lower thinner part 301 is conical, and a diameter of the lower thinner part 301 gradually increases from top to bottom, so as to form a guide when the pulp molded cup lid is closed on the cup.

As illustrated in FIG. 3 through FIG. 5, the inner convex buckle 40 has a top arc-shaped convex surface 400, a center of the top arc-shaped convex surface 400 does not overlap with a center of the groove bottom of the rolling groove 50, that is, the two centers are spaced apart from each other and located on the same horizontal plane, and the top arc-shaped convex surface 400 is connected to the upper vertical inner wall 302 and the lower inclined outward inner wall 303 respectively through arc-shaped connecting concave surfaces 401. There are two arc-shaped connecting concave surfaces 401, one is an upper connecting concave surface and the other is a lower connecting concave surface. By using the arc-shaped connecting concave surfaces, it can form transition connecting, which is beneficial to mold opening and demoulding, and can facilitate the pulp molded cup lid to be conveniently separated and combined with the cup.

Moreover, the non-coincidence of the two centers can make the wall thickness of the pulp molded cup lid thicker, so as to improve the structural strength of the pulp molded cup lid.

A manufacturing method for the pulp molded cup lid is provided in an embodiment, and the manufacturing method includes:

S1, performing molding including wet molding and hot pressing molding, to obtain a cup lid with the inner convex buckle 40 directly disposed on the inner wall of the longitudinal extension portion 30 of the cup lid; and S2, groove machining, including: performing machining on an outer wall of the longitudinal extension portion 30 of the cup lid to define a rolling groove 50 on the outer wall of the longitudinal extension portion 30 opposite to the inner convex buckle 40 to thereby obtain the pulp molded cup lid, where the machining is rolling machining or spinning machining.

Second Embodiment

Figure 6:
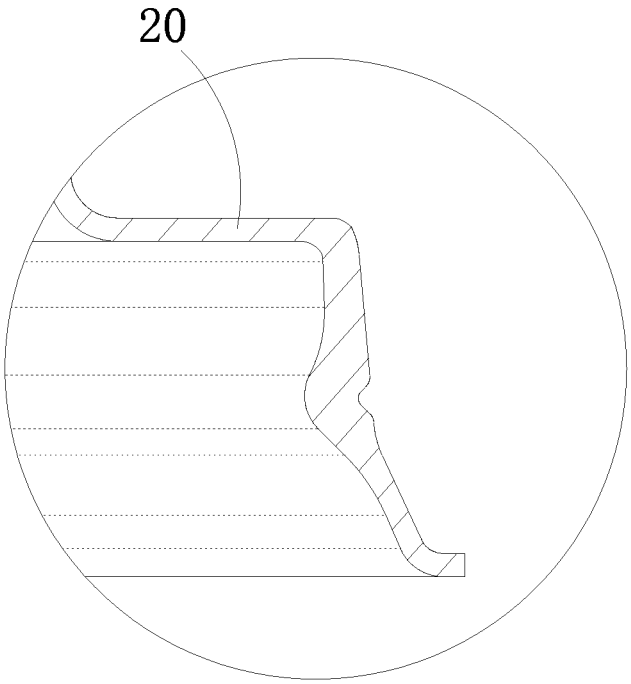
FIG. 6 illustrates a partial schematic structural diagram of a pulp molded cup lid according to a second embodiment of the disclosure.

A structure and a principle of a pulp molded cup lid of the second embodiment are basically the same as that of the first embodiment, but the difference lies in that, as illustrated in FIG. 6, the transverse extension portion 20 is a straight horizontal lateral portion (that is, upper and lower surfaces of the transverse extension portion 20 are plane and parallel to each other).

Third Embodiment

Figure 7:
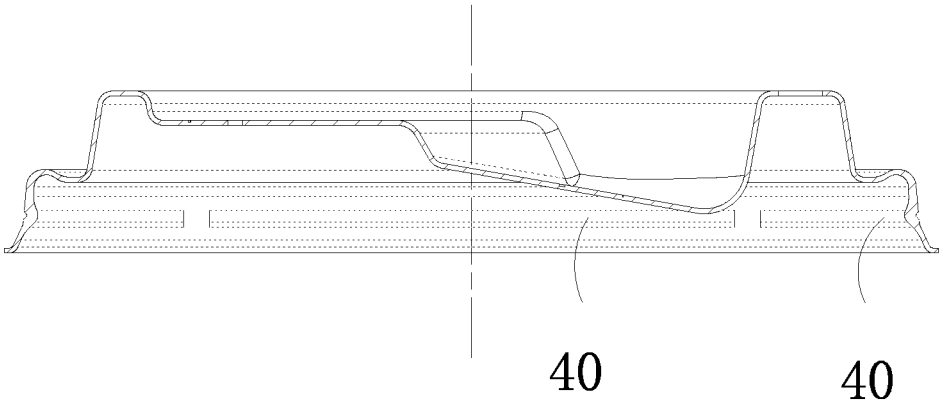
FIG. 7 illustrates a partial schematic structural diagram of a pulp molded cup lid according to a third embodiment of the disclosure.

A structure and a principle of a pulp molded cup lid of the third embodiment are basically the same as that of the first embodiment, except that, as illustrated in FIG. 7, the number of the inner convex buckle 40 is multiple, and the multiple inner convex buckles 40 are respectively multiple arc-shaped inner convex buckles evenly distributed around an inner circumference of the longitudinal extension portion 30, which are made by tightening and contracting radially inward.

Fourth Embodiment

Based on the first embodiment, as illustrated in FIG. 8, a pulp molded cup kit includes a cup 2, and the pulp molded cup kit also includes a pulp molded cup lid 1, which is any one pulp molded cup lid described in the above embodiments, and the pulp molded cup lid 1 is configured to cover a top of the cup 2.

The specific embodiments described herein are merely illustrative of the spirit of the disclosure. Those skilled in the technical field to which the disclosure belongs can make various modifications or supplements to the described specific embodiments or substitute the described specific embodiments in some similar ways, without departing from the spirit of the disclosure or exceeding the scope of protection defined in the appended claims.

What is claimed is:

1. A pulp molded cup lid, comprising:

a lid top portion (10);

a transverse extension portion (20), connected to a lower side of an outer edge of the lid top portion (10) and extending radially outward; and a longitudinal extension portion (30), connected to an outer edge of the transverse extension portion (20) and extending axially downward, wherein the longitudinal extension portion (30) is cylindrical;

wherein the pulp molded cup lid further comprises: at least one inner convex buckle (40) disposed on an inner wall of the longitudinal extension portion (30), the at least one inner convex buckle (40) and the longitudinal extension portion (30) are integrated into a single-piece structure, and the at least one inner convex buckle (40) protrudes inward relative to the inner wall of the longitudinal extension portion (30); and an outer wall of the longitudinal extension portion (30) defines a rolling groove (50), and the rolling groove (50) is configured to further reduce an inner diameter of each of the at least one inner convex buckle (40); and wherein a spacing (L1) between a groove bottom of the rolling groove (50) and an inner convex top of each of the at least one inner convex buckle (40) is greater than a thickness (H) of a single side wall of the longitudinal extension portion (30).

2. The pulp molded cup lid as claimed in claim 1, wherein a groove depth (D) of the rolling groove (50) is smaller than a protrusion length (L2) between the inner convex top of each of the at least one inner convex buckle (40) and the inner wall of the longitudinal extension portion (30).

3. The pulp molded cup lid as claimed in claim 1, wherein the rolling groove (50) is a V-shaped annular groove.

4. The pulp molded cup lid as claimed in claim 1, wherein each of the at least one inner convex buckle (40) is an annular inner convex buckle.

5. The pulp molded cup lid as claimed in claim 1, wherein the at least one inner convex buckle (40) comprises multiple inner convex buckles, the multiple inner convex buckles are arc-shaped, and the multiple inner convex buckles are evenly distributed around an inner circumference of the longitudinal extension portion (30).

6. The pulp molded cup lid as claimed in claim 1, wherein the at least one inner convex buckle (40) is disposed on a middle of the inner wall of the longitudinal extension portion (30).

7. The pulp molded cup lid as claimed in claim 6, wherein a longitudinal section of a side of the longitudinal extension portion (30) comprises: an upper thicker part (300), and a lower thinner part (301) connected to a lower side of the upper thick part (300); and wherein the at least one inner convex buckle (40) is disposed on an inner wall of the upper thicker part (300).

8. The pulp molded cup lid as claimed in claim 6, wherein a longitudinal section of a side of the longitudinal extension portion (30) comprises: an upper thicker part (300), and a lower thinner part (301) connected to a lower side of the upper thick part (300); and wherein the at least one inner convex buckle (40) is disposed on an inner wall of a joint between the upper thicker part (300) and the lower thinner part (301).

9. The pulp molded cup lid as claimed in claim 1, wherein the inner wall of the longitudinal extension portion (30) comprises an upper vertical inner wall (302) and a lower inclined outward inner wall (303) sequentially disposed in that order from top to bottom; each of the at least one inner convex buckle (40) has a top arc-shaped convex surface (400); and the top arc-shaped convex surface (400) is connected to the upper vertical inner wall (302) and the lower inclined outward inner wall (303) respectively through connecting concave surfaces (401).

10. The pulp molded cup lid as claimed in claim 1, wherein the transverse extension portion (20) comprises a straight horizontal transverse part (200) and an upward arched part (201), and a lower surface of the straight horizontal transverse part (200) and a lower surface of the upward arched part (201) are connected with each other by an arc-shaped transition convex surface (202).

11. A pulp molded cup lid, comprising:

a lid top portion (10);

a transverse extension portion (20), connected to a lower side of an outer edge of the lid top portion (10) and extending radially outward; and a longitudinal extension portion (30), connected to an outer edge of the transverse extension portion (20) and extending axially downward, wherein the longitudinal extension portion (30) is cylindrical;

wherein the pulp molded cup lid further comprises: at least one inner convex buckle (40) disposed on an inner wall of the longitudinal extension portion (30), the at least one inner convex buckle (40) and the longitudinal extension portion (30) are integrated into a single-piece structure, and the at least one inner convex buckle (40) protrudes inward relative to the inner wall of the longitudinal extension portion (30); and an outer wall of the longitudinal extension portion (30) defines a rolling groove (50), and the rolling groove (50) is configured to further reduce an inner diameter of each of the at least one inner convex buckle (40); and wherein a groove depth (D) of the rolling groove (50) is smaller than a protrusion length (L2) between an inner convex top of each of the at least one inner convex buckle (40) and the inner wall of the longitudinal extension portion (30).

* * * * *